US009803395B2

(12) United States Patent
Chen

(10) Patent No.: US 9,803,395 B2
(45) Date of Patent: Oct. 31, 2017

(54) LOCK STRUCTURE SUITABLE FOR VARIOUS LOCK CORES

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 0 days.

(21) Appl. No.: 14/943,041

(22) Filed: Nov. 17, 2015

(65) Prior Publication Data

US 2017/0138087 A1 May 18, 2017

(51) Int. Cl.

| | |
|---|---|
| ***E05B 63/08*** | (2006.01) |
| ***E05B 9/08*** | (2006.01) |
| ***E05B 15/00*** | (2006.01) |
| ***E05B 59/00*** | (2006.01) |
| *E05B 13/00* | (2006.01) |

(52) U.S. Cl.

CPC ..... *E05B 63/08* (2013.01); *E05B 9/084* (2013.01); *E05B 15/00* (2013.01); *E05B 59/00* (2013.01); *E05B 13/004* (2013.01); *Y10T 70/7661* (2015.04)

(58) Field of Classification Search

CPC ..... E05B 9/00; E05B 9/02; E05B 9/08; E05B 9/084; E05B 9/086; E05B 15/00; E05B 27/00; E05B 27/003; E05B 55/00; E05B 55/005; E05B 63/08; E05B 63/10

See application file for complete search history.

(56) References Cited

U.S. PATENT DOCUMENTS

| | | | | | |
|---|---|---|---|---|---|
| 3,999,411 | A * | 12/1976 | Kambic | E05B 55/00 | 292/165 |
| 4,389,061 | A * | 6/1983 | Foshee | E05B 59/00 | 292/169.14 |
| 6,354,121 | B1 * | 3/2002 | Frolov | E05B 63/08 | 292/144 |
| 6,543,264 | B2 * | 4/2003 | Frolov | E05B 13/005 | 70/106 |
| 7,303,215 | B2 * | 12/2007 | Moon | E05B 47/0673 | 292/169 |
| 7,533,551 | B1 * | 5/2009 | Liu | E05B 9/084 | 70/107 |
| 8,292,336 | B2 * | 10/2012 | Moon | E05B 55/00 | 292/143 |
| 8,371,627 | B2 * | 2/2013 | Chiang | E05B 55/06 | 292/1.5 |
| 8,419,086 | B2 * | 4/2013 | Moon | E05B 17/2026 | 292/108 |
| 9,262,875 | B1 * | 2/2016 | Chen | G07C 9/00007 | |
| 2005/0199026 | A1 * | 9/2005 | Geringer | E05B 47/0676 | 70/283 |

* cited by examiner

*Primary Examiner* — Christopher Boswell
(74) *Attorney, Agent, or Firm* — Leong C. Lei

(57) ABSTRACT

A lock structure suitable for various lock cores includes an engagement arranged at one side of a lock core axle of a lock device. The engagement member includes a rod section such that the engagement member is coupled to a link bar. A handle axle includes an arrestor member, such that the arrestor member is coupled to a stop plate and a push bar. A retention member is arranged under the push bar. When the lock core axle is rotated by means of a key, the engagement member and the link bar are driven to achieve locking, or a handle is operated to achieve unlocking. When the lock core is damaged, the damaged lock core is replaceable with one of various types of lock core without the need to replace the entire lock thereby improving the utilization of the lock.

6 Claims, 7 Drawing Sheets

LOCK STRUCTURE SUITABLE FOR VARIOUS LOCK CORES

(a) TECHNICAL FIELD OF THE INVENTION

The present invention relates generally to a lock structure that is suitable for various lock cores, and more particularly to a lock structure that allows for replacement of a damaged lock core with various types of lock core without the need to change the entire lock so that the utilization of the lock can be improved.

(b) DESCRIPTION OF THE PRIOR ART

A regular lock, when locked from the indoor side, is often operated by means of a rotary axle for locking, and when locked from the outdoor side, is operated with a key to rotate a lock core axle for locking and unlocking. Since the lock core is repeatedly and frequently rotated back and forth, severe wear and even damage may occur after long-term use, leading to failure of locking and unlocking. A conventional lock is designed and structured in such a way that replacement of the lock core is generally not possible and when the lock core is damaged, it is necessary to replace the entire lock, not just the lock core. This would be an economic burden for the general consumers. In view of this problem the present invention aims to provide a lock structure that is suitable for various types of lock core so that once the original lock core is damaged, the lock can be repaired by replacing the damaged lock core with any one of the various types of lock core, making it not necessary to replace the entire lock.

SUMMARY OF THE INVENTION

The primary object of the present invention is to provide a lock structure that is suitable for various lock cores so that when a lock core of the lock structure is damaged, replacement of the damaged lock core can be made with a lock core of one of various types without the need to replace the entire lock so that the utilization of the lock is improved and the economic burden of a user can be reduced.

In the above-described lock structure suitable for various lock cores, an engagement is arranged at one side of a lock core axle of a lock device. The engagement member comprises a rod section such that the engagement member is coupled to a link bar. A handle axle comprises an arrestor member, such that the arrestor member is coupled to a stop plate and a push bar. When the lock core axle is rotated by means of a key, the engagement member and the link bar are driven to achieve locking, or a handle is operated to achieve unlocking. When the lock core is damaged, the damaged lock core is replaceable with a lock core of one of various types without the need to replace the entire lock thereby improving the utilization of the lock.

In the above-described lock structure suitable for various lock cores, the engagement member comprises a mounting hole and has two ends respectively forming the rod section and a hook section, such that the engagement member is mounted by means of the mounting hole to the lock device and a spring is mounted to the engagement member with two ends of the spring respectively supported on the link bar and the hook section.

In the above-described lock structure suitable for various lock cores, the link bar in the form of an elongate plate having an end forming a projection and also having upper and lower edges that respectively comprise a notch and fitting sections formed thereon so that the link bar is mounted to the lock device by means of the fitting sections and the rod section of the engagement member is received and positioned in the notch.

In the above-described lock structure suitable for various lock cores, the arrestor member is in the form of a ring having an outer circumference on which a first drive bar and a second drive bar are formed so that the first drive bar is mounted to a lower part of the link bar and the second drive bar is mounted to the push bar.

In the above-described lock structure suitable for various lock cores, the stop plate has an end on which fitting sections are formed so as to be mounted to the lock device by means of the fitting sections. The retention member has an end on which fitting sections are formed so as to be mounted to the lock device by means of the fitting sections.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
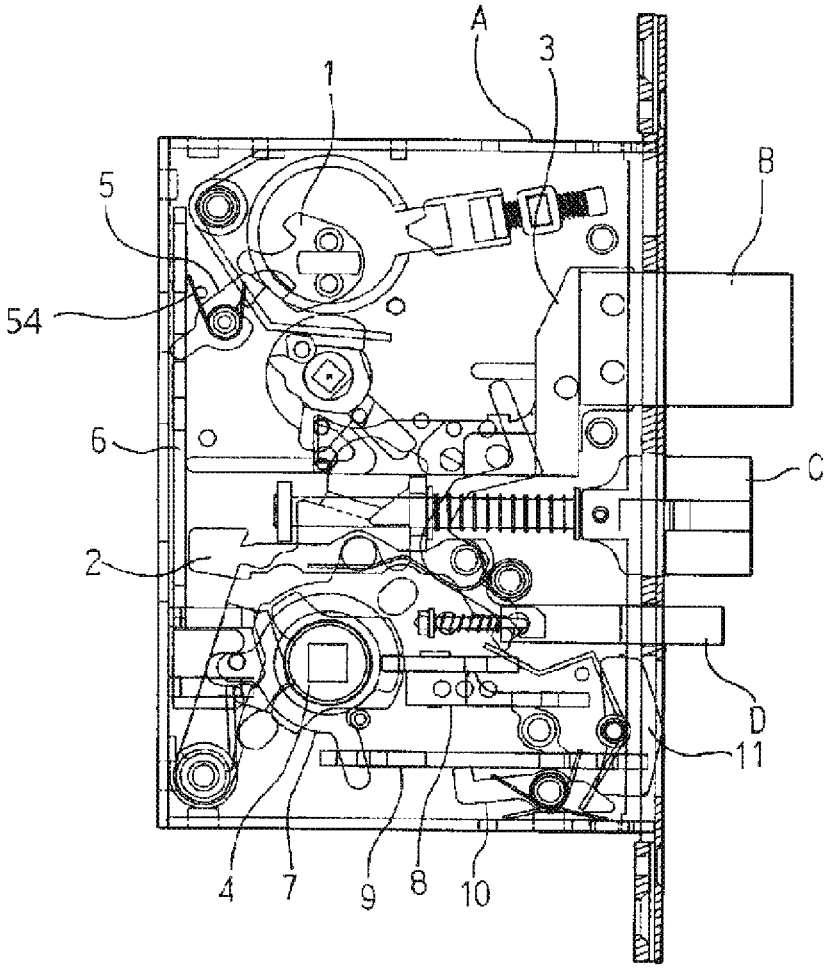
FIG. 1 is a schematic view illustrating a structure according to the present invention.
Figure 2:
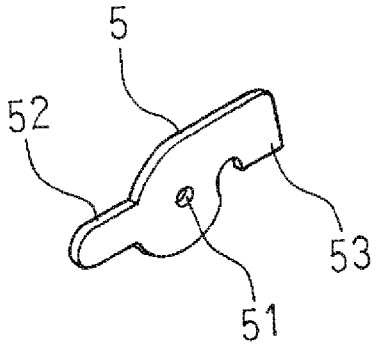
FIG. 2 is a perspective view illustrating an engagement member of the present invention.
Figure 3:
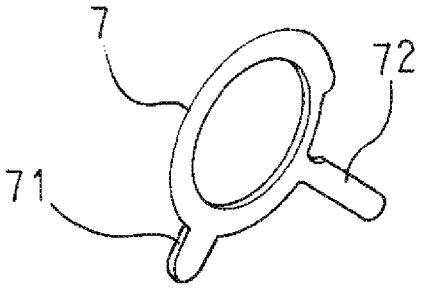
FIG. 3 is a perspective view illustrating an arrestor member of the present invention.
Figure 4:
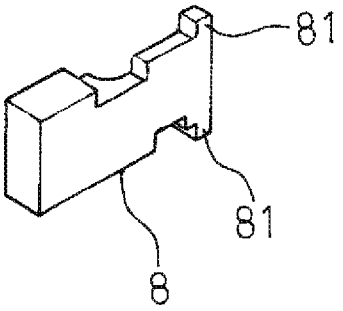
FIG. 4 is a perspective view illustrating a stop plate of the present invention.
Figure 5:
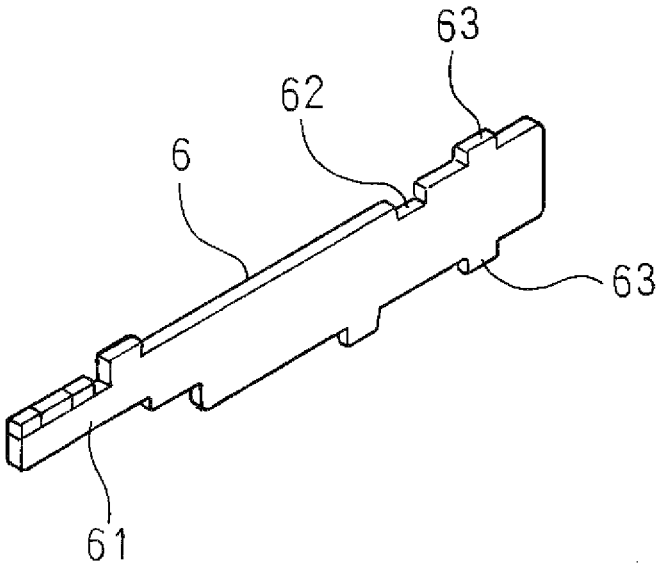
FIG. 5 is a perspective view illustrating a link bar of the present invention.
Figure 6:
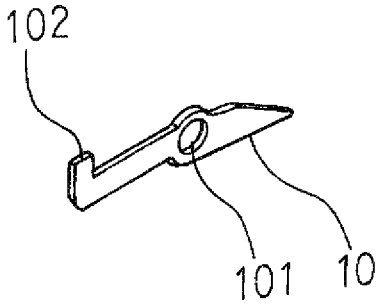
FIG. 6 is a perspective view illustrating a retention member of the present invention.

Referring to FIG. 1, a schematic view is given to illustrate a structure according to the present invention. As shown in the drawing, the present invention comprises, in lock device A, a rectangular bolt B, a triangular bolt C, and a latch D, and a lock core axle 1, an oscillation bar 2, a push bar 3, and a handle axle 4 that is rotatably mounted and coupled to a handle. An engagement member 5 is arranged at one side of the lock core axle 1 in such a way that the engagement member 5 is coupled to a link bar 6. The handle axle 4 is provided with an arrestor member 7 such that the arrestor member 7 is coupled to a stop plate 8 and a push bar 9. A retention member 10 is arranged under the push bar 9.

Referring collectively to FIGS. 2-6, which are respectively a perspective view of the engagement member, a perspective view of the arrestor member, a perspective view of the stop plate of the present invention, a perspective view of the link bar, and a perspective view of the retention member of the present invention, as shown in the drawings, according to the present invention, the engagement member 5 comprises a mounting hole 51 and has two opposite ends respectively forming a rod section 52 and a hook section 53, such that the engagement member is mounted via the mounting hole 51 to the lock device A and a spring 54 is mounted to the engagement member 5 in such a way that two ends of the spring 54 are respectively supported on the link bar 6 and the hook section 53.

The link bar 6 is in the form of an elongate plate having an end forming a projection 61 and also having upper and lower edges that respectively comprise a notch 62 and fitting sections 63 formed thereon so that the link bar 6 is mounted to the lock device A by means of the fitting sections 63 and the rod section 52 of the engagement member 5 is received and positioned in the notch 62.

The arrestor member 7 is in the form of a ring having an outer circumference on which a first drive bar 71 and a second drive bar 72 are formed so that the first drive bar 71 is mounted to a lower part of the link bar 6 and the second drive bar 72 is mounted to the push bar 9.

The stop plate 8 has an end on which fitting sections 81 are formed so as to be mounted to the lock device A by means of the fitting sections 81.

The retention member 10 is in the form of a plate and comprises a mounting hole 101 for mounting to the lock device A and has an end forming a pawl section 102.

With a combination of the above components, a lock structure that is suitable for various lock cores is constructed. When the lock core axle 1 is rotated by means of a key, driving can be conducted through the engagement member 5 and the link bar 6 to achieve locking, or unlocking can be performed with the handle. When the lock core is damaged, the lock core can be replaced with any one of various types of lock core and there is no need to replace the entire lock device. This improves the utilization of the lock device.

Figure 7:
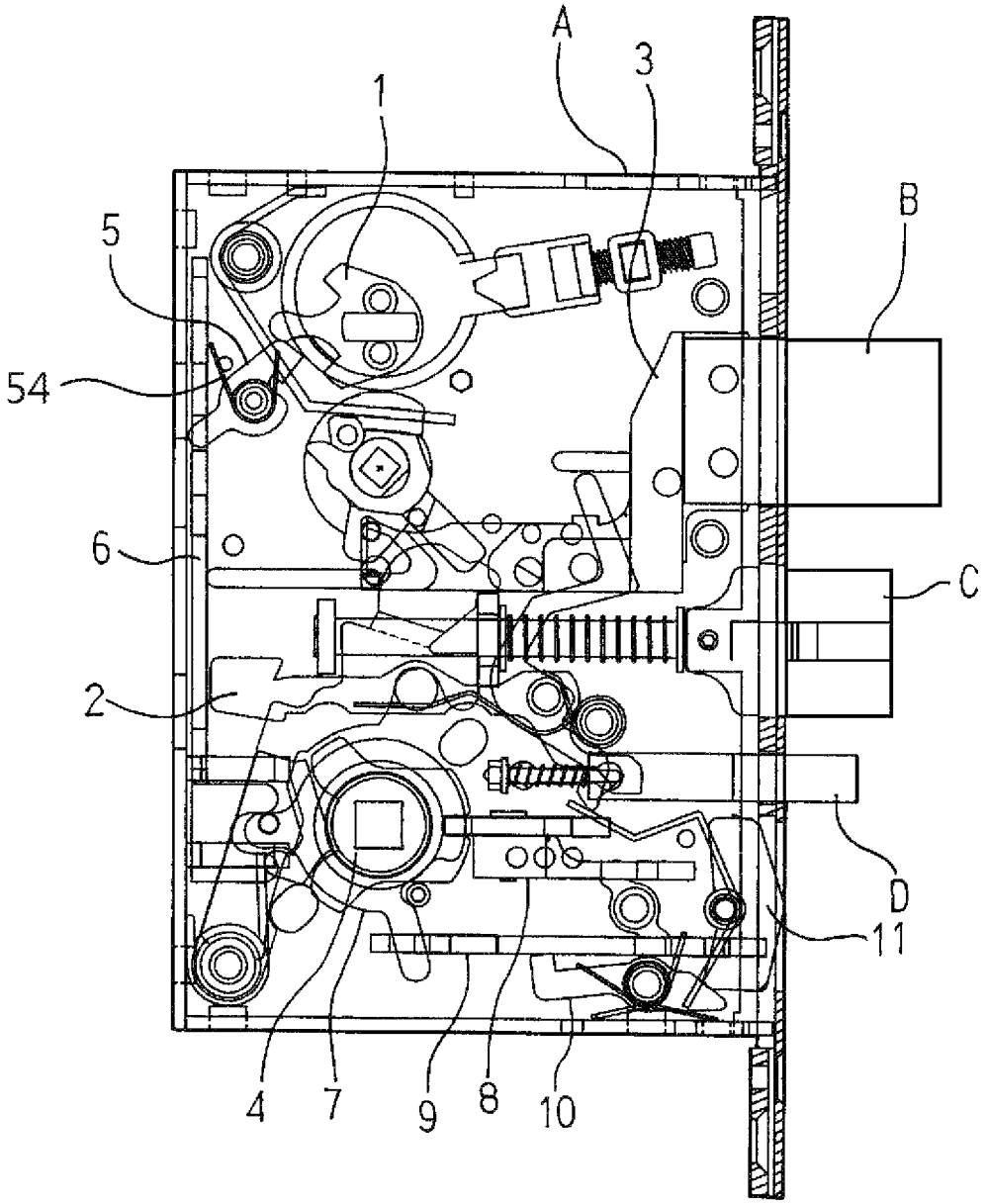
FIGS. 7 and 9 are schematic views illustrating a locking operation of the present invention.
Figure 9:
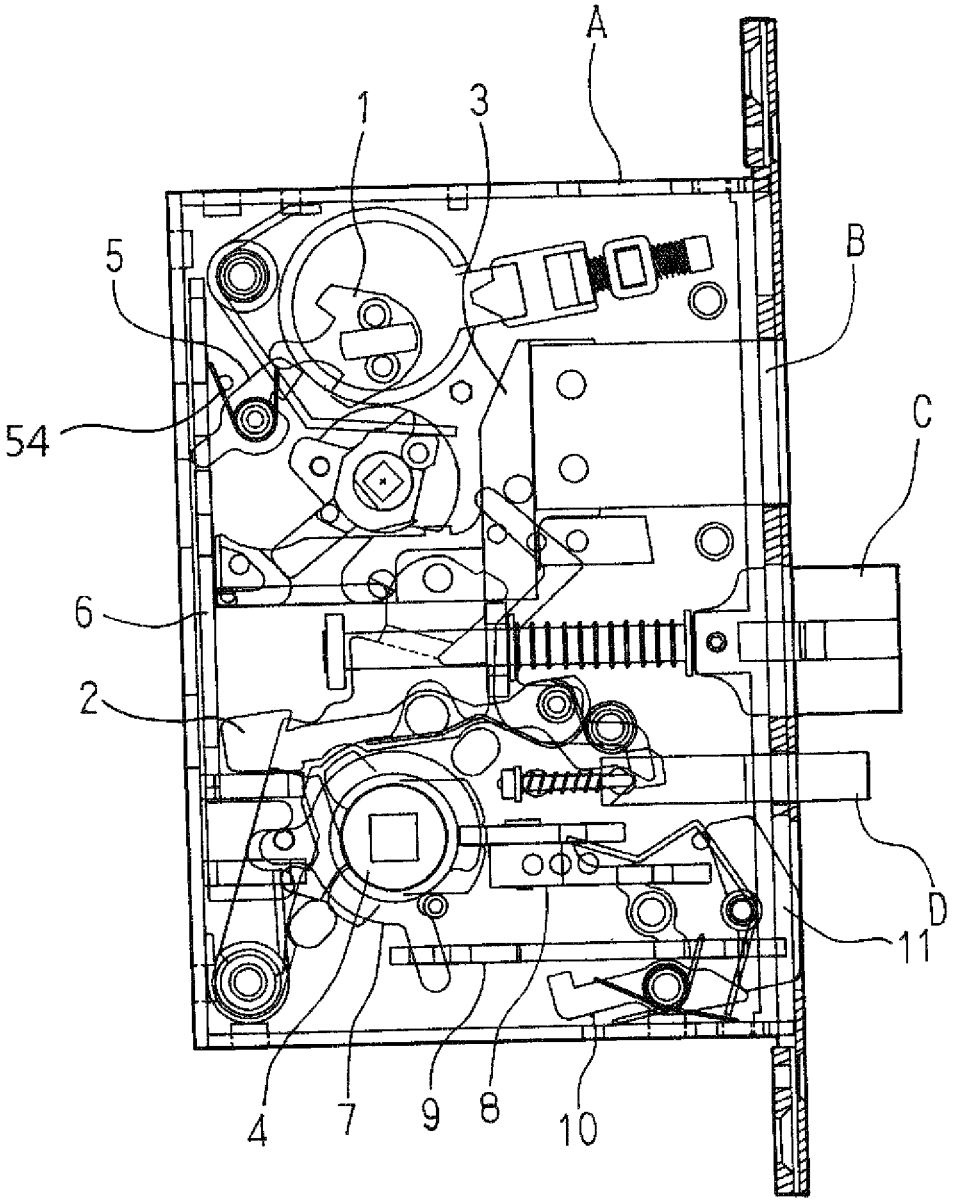

Referring collectively to FIGS. 7 and 9, schematic views are provided to illustrate a locking operation of the present invention. As shown in the drawings, to operate the present invention for locking, the lock core axle 1 is rotated to drive the engagement member 5 to rotate for an angle so as to push the link bar 6 downward (see FIG. 7), thereby driving the first drive bar 71 of the arrestor member 7 to rotate by an angle and correspondingly, the second drive bar 72 pushing the push bar 9 in an outward direction. As such, the rectangular bolt B, the triangular bolt C, and the latch D are extended out of the lock device A, whereby through depression of the depression member 11 located under the lock device A, the stop plate 8 is caused to slide inwardly to engage the handle axle 4 so as to achieve a locked condition.

Figure 8:
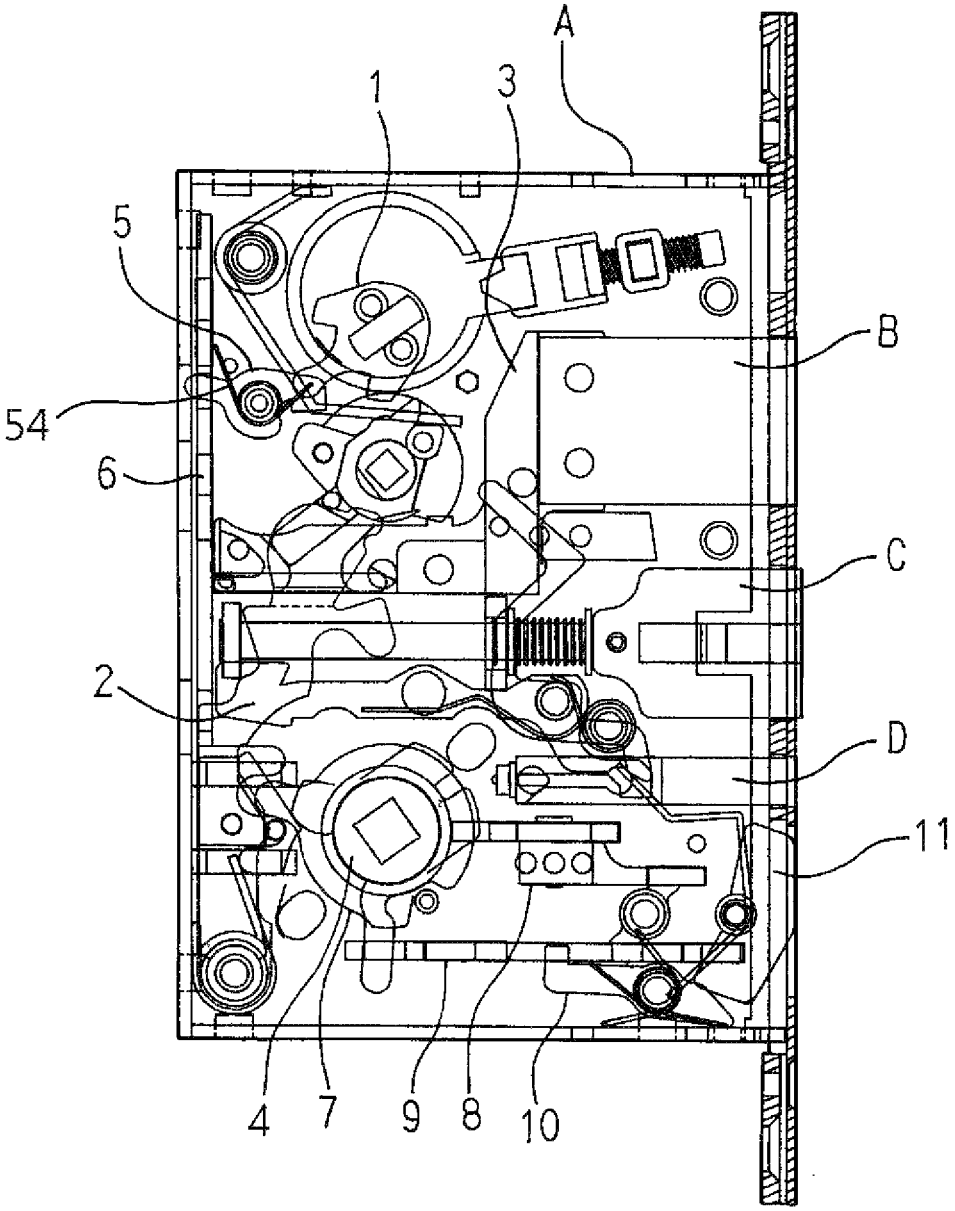
FIGS. 8 and 10 are schematic views illustrating an unlocking operation of the present invention.
Figure 10:
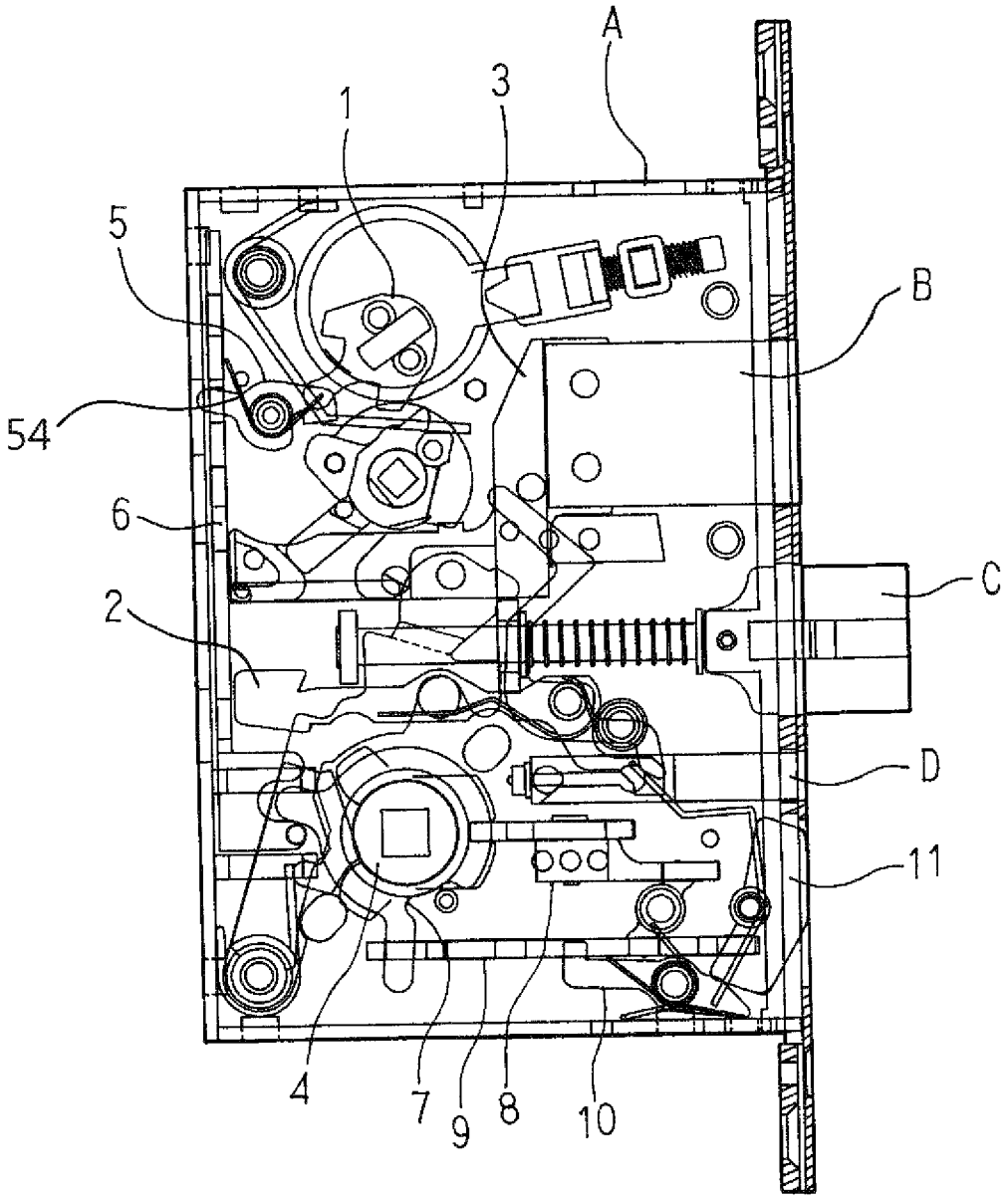

Referring collectively to FIGS. 8 and 10, schematic views are given to illustrate an unlocking operation of the present invention. As shown in the drawings, to operate the present invention for unlocking, the lock core axle 1 is rotated in an opposite direction to drive the engagement member 5 to rotate by an angle so as to pull the link bar 6 upward (see FIG. 8), thereby driving the first drive bar 71 of the arrestor member 7 to rotate by an angle and correspondingly, the second drive bar 72 pulling the push bar 9 in an inward direction. As such, the rectangular bolt B, the triangular bolt C, and the latch D are retracted inward into the lock device A to achieve an unlocked condition.

The locking and unlocking operations of the present invention are achieved by having the lock core axle 1 drive the engagement member 5, so that when the lock core gets damaged or worn out resulting from long term use, the lock core can be removed and replaced with any one of various types of lock core and there is no need to replace the entire lock so that the utilization of the lock device is improved and the economic burden of the user is reduced.

The embodiment described above is provided as a preferred form of the present invention for illustration purposes and is not to constrain the scope of the present invention. Minor modifications and variations, which are well within the inventive essence of the present invention, are considered belonging to the scope of the present invention.

In summary, the present invention provides a lock structure suitable for various lock cores by proper assembly of a lock core axle, an oscillation bar, and a push bar, in combination with a movable arrestor member and an engagement member, a link bar, a stop plate, and a push bar. When the lock core axle is rotated by means of a key, the engagement member and the link bar are driven to achieve locking or unlocking is achieved with operation of a handle. Further, when the lock core is damaged, the damaged lock core can be removed and replaced with any one of various types of lock core without the need to replace the entire lock.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A lock structure, suitable for various types of lock core, comprising an engagement member arranged at one side of a lock core axle of a lock device and operatively coupled to the lock core axle to be rotatable by the lock core axle, the engagement member comprising a rod section such that the engagement member is coupled to a link bar through the rod section engaging the link bar, a handle axle comprising an arrestor member that comprises a first drive bar that is coupled to and rotatable by a lower part of the link bar, such that the arrestor member is coupled to a stop plate and a push bar, a retention member being arranged under the push bar, wherein when the lock core axle is rotated by means of a key, the engagement member is rotated from a first angular position to a second angular position and the link bar that is coupled to the engagement member through the rod section of the engagement member is driven to move linearly from a first linear position to a second linear position to in turn rotate the arrestor member from a third angular position to a fourth angular position to achieve locking;

wherein an operation of the lock core axle causes a first rotary motion of the engagement member, which is converted into a linear motion of the link bar and further converted into a second rotary motion of the arrestor member such that the second rotary motion of the arrestor member drives the push bar for operating latches/bolts for locking.

2. The lock structure according to claim 1, wherein the engagement member comprises a mounting hole and has two ends respectively forming the rod section and a hook section, such that the engagement member is mounted by means of the mounting hole to the lock device and a spring is mounted to the engagement member with two ends of the spring respectively supported on the link bar and the hook section.

3. The lock structure according to claim 1, wherein the link bar is in the form of an elongate plate having an end forming a projection and also having upper and lower edges that respectively comprise a notch and fitting sections formed thereon so that the link bar is mounted to the lock device by means of the fitting sections and the rod section of the engagement member is received and positioned in the notch.

4. The lock structure according to claim 1, wherein the arrestor member is in the form of a ring having an outer circumference on which the first drive bar and a second drive bar are formed so that the second drive bar that is mounted to the push bar to drive the push bar.

5. The lock structure according to claim 1, wherein the stop plate has an end on which fitting sections are formed so as to be mounted to the lock device by means of the fitting sections.

6. The lock structure according to claim 1, wherein the retention member has an end on which fitting sections are formed so as to be mounted to the lock device by means of the fitting sections.

* * * * *